US006814432B2

(12) United States Patent
Yamada et al.

(10) Patent No.: US 6,814,432 B2
(45) Date of Patent: Nov. 9, 2004

(54) INKJET RECORDING DEVICE AND INK SUPPLYING DEVICE EMPLOYED THEREBY

(75) Inventors: Takahiro Yamada, Hitachinaka (JP); Kunihiro Tamahashi, Hitachinaka (JP); Akemi Ouchi, Hitachinaka (JP); Kunio Satou, Hitachinaka (JP); Kazuo Shimizu, Hitachinaka (JP); Hitoshi Kida, Hitachinaka (JP); Hidetoshi Fujii, Hitachinaka (JP)

(73) Assignee: Hitachi Printing Solutions, Ltd., Kanagawa-ken (JP)

( * ) Notice: Subject to any disclaimer, the term of this patent is extended or adjusted under 35 U.S.C. 154(b) by 0 days.

(21) Appl. No.: 10/455,323

(22) Filed: Jun. 6, 2003

(65) Prior Publication Data

US 2003/0227524 A1 Dec. 11, 2003

(30) Foreign Application Priority Data

Jun. 6, 2002 (JP) ..... P2002-165178

(51) Int. Cl.[7] ..... B41J 2/175
(52) U.S. Cl. ..... 347/85
(58) Field of Search ..... 347/85, 86, 87; 141/2, 7, 8

(56) References Cited

U.S. PATENT DOCUMENTS 4,007,684 A * 2/1977 Takano et al. ..... 101/366
5,875,615 A * 3/1999 Ito et al. ..... 53/474
6,007,193 A * 12/1999 Kashimura et al. ..... 347/92
6,213,596 B1 * 4/2001 Nowell et al. ..... 347/85
6,224,201 B1 * 5/2001 Shigemura ..... 347/93
6,375,402 B1 * 4/2002 Hertelendi et al. ..... 414/373

FOREIGN PATENT DOCUMENTS

| | | |
|---|---|---|
| JP | 56113464 | 9/1981 |
| JP | 7195685 | 8/1995 |
| JP | 7223322 | 8/1995 |
| JP | 11227228 | 8/1999 |

* cited by examiner

*Primary Examiner*—Anh T.N. Vo
(74) *Attorney, Agent, or Firm*—Whitham, Curtis & Christofferson, PC

(57) ABSTRACT

An inkjet recording device includes an ink reservoir that stores ink, a recording head having a plurality of nozzle holes for forming recording dots on a recording medium by ejecting ink particles from the plurality of nozzle holes onto the recording medium positioned opposite the plurality of nozzle holes, an ink channel for supplying ink from the ink reservoir to the recording head, ink discharging means for discharging ink from the recording head and the ink channel, evacuating means for creating a vacuum state in the recording head and the ink channel, and ink filling means for filling the evacuated recording head and ink channel with deaerated ink. The ink discharging means divides the recording head and the ink channel into a plurality of sections and independently discharges ink from each section of the recording head and the ink channel.

20 Claims, 9 Drawing Sheets

INKJET RECORDING DEVICE AND INK SUPPLYING DEVICE EMPLOYED THEREBY

BACKGROUND OF THE INVENTION

1. Field of the Invention

The present invention relates to an inkjet recording device and an ink supplying device employed thereby.

2. Description of Related Art

Line scanning type inkjet printers have been proposed as high-speed inkjet printers for printing on continuous recording paper at high speeds. These devices have a page-width long recording head spanning the entire width of a continuous recording paper and formed with rows of nozzle holes from which ink particles are ejected. This page-width line recording head is positioned opposite the recording paper and is selectively controlled according to recording signals to deposit ink particles ejected from the nozzle holes onto the recording paper. At the same time, a main scanning process is performed by moving the recording paper at a high speed in the lengthwise direction of the continuous recording paper. An image is formed on the recording paper by controlling the main scanning process and the deposition of ink particles to form recording dots.

Many examples of line scanning type inkjet printers have been proposed to date, such as devices that include a recording head employing a continuous inkjet system and devices that include a recording head employing an on-demand inkjet system. While the on-demand type line scanning inkjet printers cannot equal the recording rate of devices using the continuous inkjet system, the on-demand inkjet system has proved suitable for use in high-speed printers that are in widespread use, due to the simple construction of the ink system and the like.

The recording head in line scanning inkjet printers using the on-demand inkjet system is a line-type recording head in which a plurality of nozzles is provided in rows. The nozzle holes serve as openings to an ink chamber filled with ink. Ink particles can be ejected via the nozzle holes by applying a drive voltage to piezoelectric elements or heat elements to increase pressure in the ink. An ink supplying device is connected to this recording head for supplying ink to the each nozzle.

When supplying ink from the ink supplying device into the recording head, the ink includes air bubbles that remain in the ink chamber. When pressure is applied to ink in the ink chamber in which residual air bubbles exist, volume changes in the ink chamber are absorbed by the contraction of these residual air bubbles, resulting in improper ejection of ink droplets from the nozzle holes and unsatisfactory recording quality. The problem of residual air bubbles is more serious in line-type inkjet printers than in serial printers because line-type inkjet printers are provided with numerous nozzles and perform one-pass recording.

Conventional methods for overcoming these problems include a first filling method employing the capillary effect and the wettability of material contacted by the ink to eliminate flow stagnant areas in the ink channel and to introduce ink free from residual air bubbles, or this method combined with a purge process. A method using the capillary effect used above is disclosed in Japanese patent-application publication (Kokai) No. HEI-11-227228, while a method using the wettability of material contacted by ink is disclosed in Japanese patent-application publication (Kokai) No. HEI-7-223322. A method for eliminating flow stagnant areas in the ink channels is disclosed in Japanese patent-application publication (Kokai) No. HEI-7-195685.

A second filling method expected to achieve further improvements is disclosed in Japanese patent-application publication (Kokai) No. SHO-56-113464. In this method, the recording head and ink channels in the ink supplying device are evacuated prior to replacing the space with ink.

SUMMARY OF THE INVENTION

However, line scanning type inkjet printers employ long recording heads with numerous nozzles. Further, since sufficient ink must be supplied to these numerous nozzles, the ink supplying channels must be wider in diameter. In addition, the ink supplying channels tend to become complex in construction. Accordingly, when applying the first filling method to a line scanning type inkjet printer, it is difficult to fill the channels with ink free from residual air bubbles.

While improvements have been made in the second filling method, this method is still insufficient for line scanning type inkjet printers. Problems have arisen particularly in the process of filling the recording device with ink after assembly, due to some problems in the initial filling stage. Further, when attempting to refill the recording device a second time, it is more difficult to raise the vacuum level in the various components, requiring more time. The success rate for refilling the recording device a second time tends to be lower than that of the first filling attempt. Further, when refilling the recording device during short interims between print jobs, during maintenance, or the like and then attempting to resume a recording operation immediately, filling the device satisfactorily with ink free from residual air bubbles has proven to be even more difficult. In addition, the nozzle holes occasionally become clogged during the ink refilling process.

In view of the foregoing, it is an object of the present invention to provide an inkjet recording device and an ink supplying device employed by the inkjet recording device that are capable of filling the recording head and ink supply channels with ink free from residual air bubbles reliably and within a short amount of time, thereby making it possible to resume highly reliable recording operations quickly, even in line scanning type inkjet printers having numerous nozzles and complex ink supply channels that are long and wide in diameter.

In order to attain the above and other objects, the present invention provides an inkjet recording device. The inkjet recording device includes an ink reservoir that stores ink, a recording head having a plurality of nozzle holes for forming recording dots on a recording medium by ejecting ink particles from the plurality of nozzle holes onto the recording medium positioned opposite the plurality of nozzle holes, an ink channel for supplying ink from the ink reservoir to the recording head, ink discharging means for discharging ink from the recording head and the ink channel, evacuating means for creating a vacuum state in the recording head and the ink channel, and ink filling means for filling the evacuated recording head and ink channel with deaerated ink, wherein the ink discharging means divides the recording head and the ink channel into a plurality of sections and independently discharges ink from each section of the recording head and the ink channel.

The present invention also provides an inkjet recording device. The inkjet recording device includes an ink reservoir that stores ink, a recording head having a plurality of nozzle holes for forming recording dots on a recording medium by ejecting ink particles from the plurality of nozzle holes onto the recording medium positioned opposite the plurality of nozzle holes, an ink channel for supplying ink from the ink reservoir to the recording head, ink discharging means for discharging ink from the recording head and the ink channel, evacuating means for creating a vacuum state in the recording head and the ink channel, and ink filling means for filling the evacuated recording head and ink channel with deaerated ink, wherein the ink discharging means includes external air introducing means introducing external air into the ink channel.

The present invention also provides an ink supplying device. The ink supplying device is used for an inkjet recording device having a recording head. The ink supplying device selectively supplies one of a plurality of types of ink to the recording head. The ink supplying device includes for each of the plurality of types of ink an ink channel for supplying ink to the recording head, ink discharging means for discharging ink from the recording head and the ink channel, evacuating means for creating a vacuum state in the recording head and the ink channel, and ink filling means for filling the evacuated recording head and ink channel with deaerated ink, wherein the ink discharging means comprises external air introducing means introducing external air into the ink channel.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

An inkjet recording device and ink supplying device according to preferred embodiments of the present invention will be described while referring to the accompanying drawings.

Figure 1:
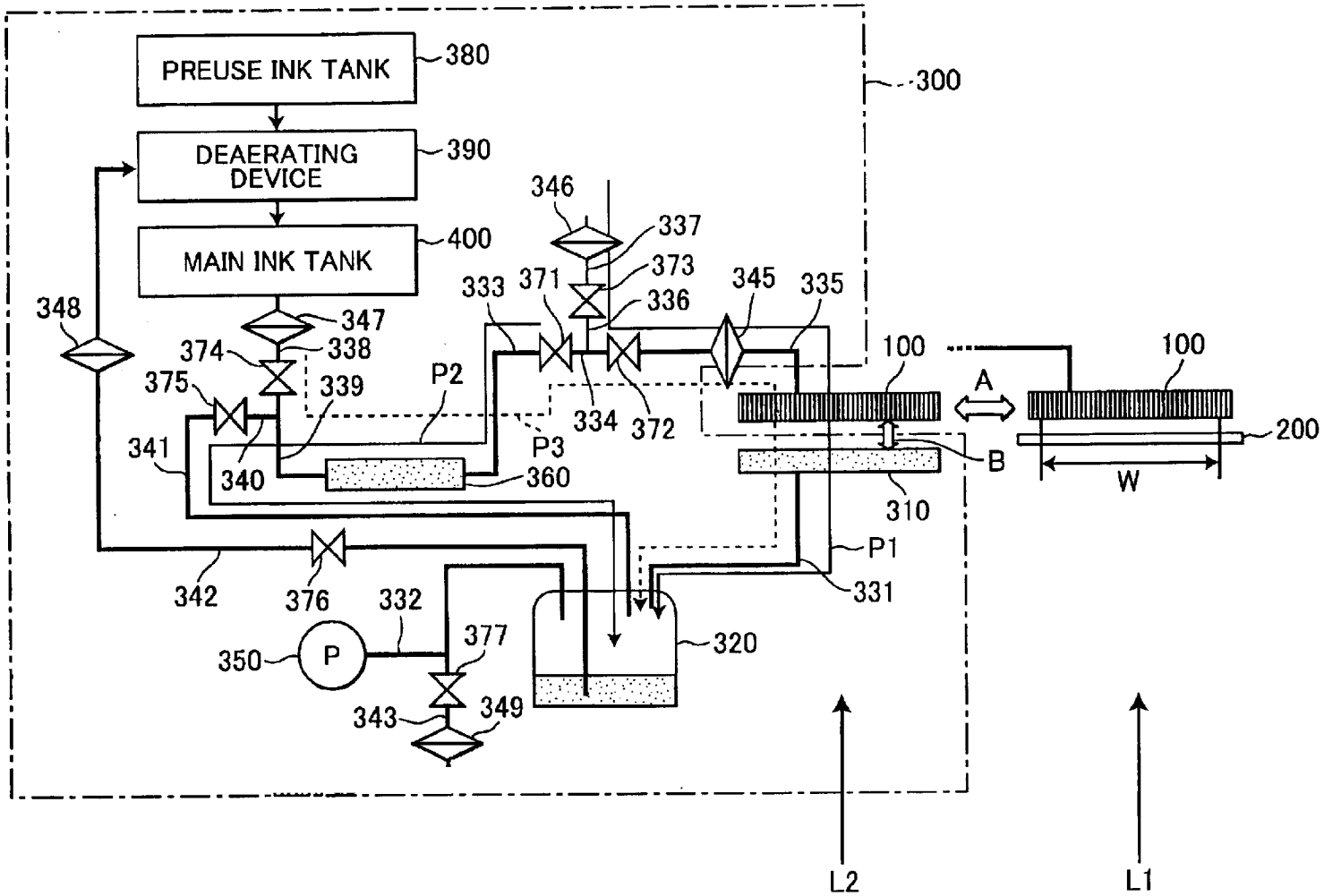
FIG. 1 is an explanatory diagram showing the construction of an ink supplying device for an inkjet recording device according to a first embodiment of the present invention.

FIG. 1 is an explanatory diagram showing the construction of an ink supplying device for an inkjet recording device according to the first embodiment of the present invention. The inkjet recording device according to the first embodiment includes a printing device, an ink supplying device, and other devices not shown in the drawings, such as a paper conveying unit and the like. FIG. 1 shows a recording head 100 of the printing device and an ink supplying device 300.

The recording head 100 is employed in a line type inkjet printer. The recording head 100 receives ink supplied from the ink supplying device 300 and ejects ink droplets onto the surface of a recording paper 200 to record images based on recording signals. The recording head 100 is provided with numerous nozzles having a width W equivalent to the page width of the recording paper 200. The recording head 100 is capable of moving reciprocally in the direction indicated by an arrow A between a recording operation position L1 for performing a recording operation and an ink filling position L2 for filling the ink supplying channel with ink.

The ink supplying device 300 includes a nozzle cap 310, a negative pressure maintaining ink reservoir 320, a vacuum pump 350, a ink head reference bag 360, a preuse ink tank 380, a deaerating device 390, a main ink tank 400, a plurality of tubes connecting the above devices, and a plurality of filters provided in the tubes. The nozzle cap 310 is disposed at a position opposite the recording head 100 when the recording head 100 is in the ink filling position L2. The nozzle cap 310 hermetically seals the nozzle openings in the recording head 100 by moving in the direction of an arrow B. The nozzle cap 310 is in fluid communication with the negative pressure maintaining ink reservoir 320 via a tube 331.

The preuse ink tank 380 accumulates new ink prior to use. The deaerating device 390 is a device for removing gas from ink supplied from the preuse ink tank 380. The main ink tank 400 is provided to accumulate ink that has been deaerated by the deaerating device 390.

The ink head reference bag 360 is a deformable or flexible container that is provided with an ink level sensor (not shown) Through control of the ink level sensor and opening and closing of a valve 374 described later, an appropriate amount of deaerated ink is maintained at all times. The vacuum pump 350 decreases the pressure in the negative pressure maintaining ink reservoir 320 to create and maintain a negative pressure therein.

The negative pressure maintaining ink reservoir 320 has a capacity sufficiently larger than the volume of an ink filling path P3 described later. The negative pressure maintaining ink reservoir 320 is provided for temporarily storing ink discharged from the ink channel while being maintained at a negative pressure by the vacuum pump 350. A plurality of tubes is provided to fluidly connect the nozzle cap 310, vacuum pump 350, ink head reference bag 360, and deaerating device 390 to the negative pressure maintaining ink reservoir 320.

The tube 331 is connected to the nozzle cap 310 and leads to the negative pressure maintaining ink reservoir 320. The negative pressure maintaining ink reservoir 320 is connected to the vacuum pump 350 via a tube 332. A leak valve 377 and a filter 349 are connected to the tube 332 via a tube 343. The recording head 100 is connected to the ink head reference bag 360 via tubes 335, 334, and 333. A filter 345 is provided at a position along the tube 335. The tubes 333 and 334 are connected via a valve 371, while the tubes 334 and 335 are connected via a valve 372. A tube 336 is connected to the middle of the tube 334. The tube 336 is connected to a tube 337 via a leak valve 373. A filter 346 is provided on the tube 337. The end of the tube 337 is open to the external air.

Further, the preuse ink tank 380 is in fluid communication with the deaerating device 390, while the deaerating device 390 is connected to the main ink tank 400. The deaerating device 390 is also connected to the negative pressure maintaining ink reservoir 320 via a tube 342. A filter 348 and a valve 376 are provided at positions along the tube 342. The main ink tank 400 and the ink head reference bag 360 are connected via tubes 338 and 339. The valve 374 is disposed between the tube 338 and tube 339. A filter 347 is provided at a position along the tube 339. A tube 340 is connected to the middle of the tube 339 on one end and on the other to a tube 341 via a valve 375. The tube 341 leads to the negative pressure maintaining ink reservoir 320.

When the recording device is performing a recording operation, the recording head 100 is in the recording operation position L1. The valve 371 and valve 372 are open and the leak valve 373 and valve 374 are closed, thereby supplying deaerated ink accumulated in the ink head reference bag 360 to the recording head 100 via the tubes 333, 334, and 335. As the recording operation continues and deaerated ink in the ink head reference bag 360 drops, the ink level sensor (not shown) detects this state. When a low ink level is detected, the valve 374 is opened and deaerated ink accommodated in the main ink tank 400 is supplied to the ink head reference bag 360, after which the valve 374 is again closed. By controlling the opening and closing of the valve 374, an appropriate level of deaerated ink can be maintained constantly in the ink head reference bag 360. Accordingly, the recording head 100 can continue performing a recording operation on the recording paper 200 when in the recording operation position L1.

However, when recording operations are performed over a long period of time, air bubbles are sometimes generated in the nozzles of the recording head 100. Normally these air bubbles are discharged from the recording head 100 in a purge process or vanish when they are absorbed in the deaerated ink, which enables continuing normal recording operations. However, on rare occasions, air bubbles are not sufficiently discharged during the purge process or are not sufficiently dissolved in the deaerated ink. In these cases, the air bubbles accumulate in the nozzles and the ink chamber, resulting in poor ink ejection from the nozzles. Line type color inkjet printers are provided with tens of thousands of nozzles, greatly exceeding the number provided in serial type color inkjet printers. Hence, there is a much greater potential for this problem to occur in one of the nozzles in the line type color inkjet printer.

In some cases, performing a purge process to improve nozzles having defective ejection only makes the problem of air bubbles in the nozzles worse. In the conventional purge process, a nozzle cap is mounted over the nozzle holes, and a negative pressure is applied to the nozzle holes to discharge ink therefrom and to remove air bubbles residing near the nozzle holes and in the ink chamber. However, when the seal of the nozzle cap is poor, outside air seeps in through gaps in the nozzle cap during the purge process and enters the ink chamber through the nozzle holes, thereby worsening the problem of residual air bubbles.

The ink supplying device shown in FIG. 1 is configured by connecting and assembling numerous parts, including the recording head, valves, filters, tubes, and the like. After the recording device has been operated for a long period of time, the airtightness in connections between parts and in the parts themselves deteriorates, allowing air bubbles to form in the ink supplying system. Further, when parts become defective or when maintenance is performed on filters or other parts in the ink supplying system or on the recording head, it is necessary to remove those parts from the ink supplying system, thereby allowing air bubbles to accumulate in the ink supplying system.

Since ink must be supplied to numerous nozzles in a line type inkjet printer, the ink supplying channels are complex and are long and wide in diameter. Accordingly, it is difficult to rid the ink channels completely of residual air bubbles with conventional methods that employ purging, the ink capillary effect, or the wettability of parts. Occasionally, air bubbles unexpectedly enter the nozzles in these types of printers, causing problems in ink ejection.

The inkjet recording device and ink supplying device according to the present invention enable the recording head and ink supplying channel to be refilled with ink free from residual ink bubbles, thereby enabling proper recording operations to be resumed quickly.

Figure 2:
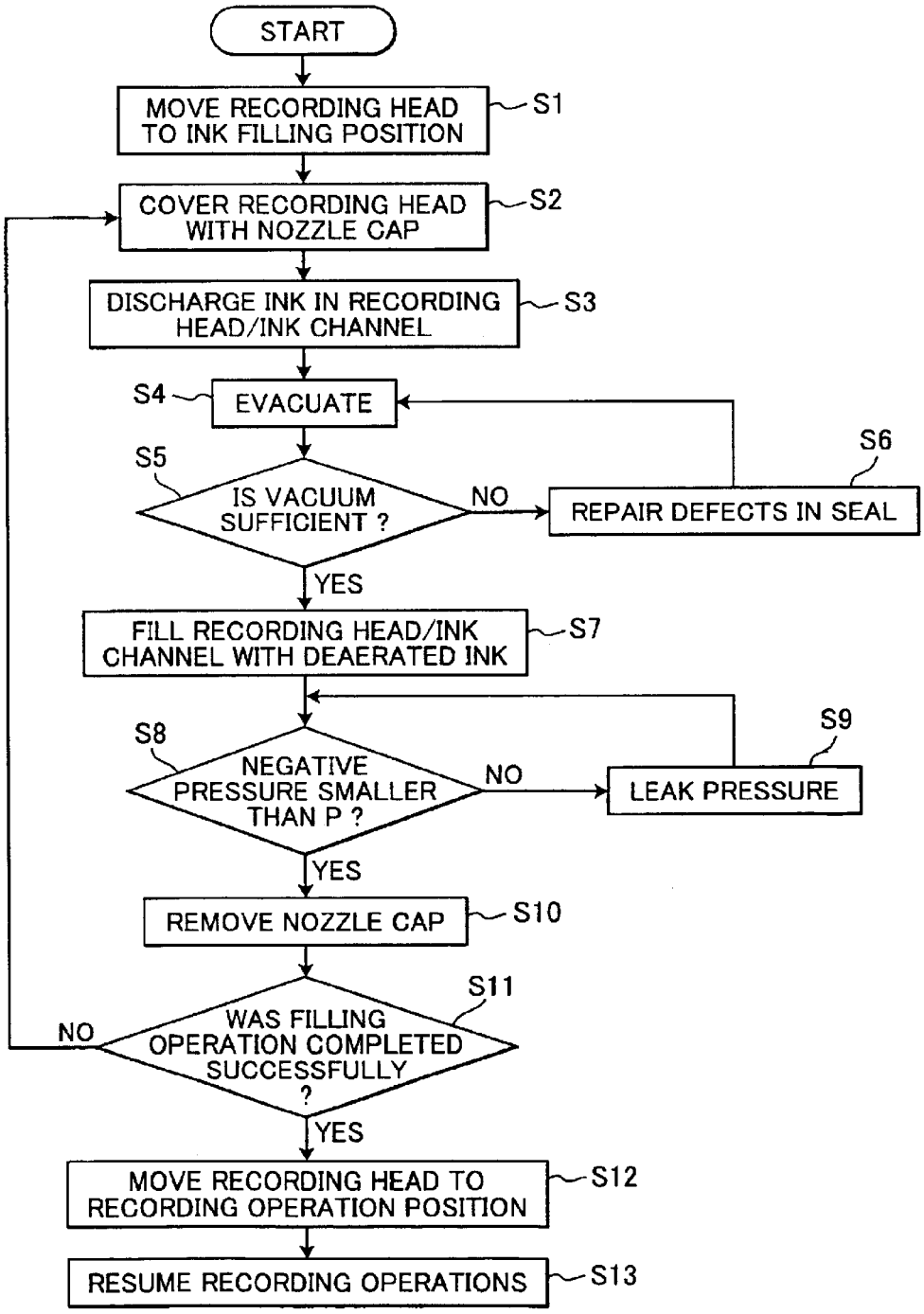
FIG. 2 is a flowchart showing steps in an ink refilling operation performed by the ink supplying device.

Next, an ink refilling operation according to the present invention will be described with reference to the flowchart in FIG. 2. In the following description, "step" is abbreviated as "S." In a first process, ink is discharged from the ink supplying channel. This process is performed according to the following sequence of steps.

(1) The recording head 100 is moved to the ink filling position L2 (S1).
(2) The openings of nozzles in the recording head 100 are hermetically sealed by the nozzle cap 310 (S2).
(3) The valves 371 and 376 are closed, while the valves 372 and 373 are opened.
(4) The vacuum pump 350 is operated to create a negative pressure in the negative pressure maintaining ink reservoir 320. As the tube 337 is opened to the external air via the filter 346, the air having been cleared of foreign matter or debris by the filter 346 forces the ink in the filter 345, tube 335, recording head 100, nozzle cap 310, and tube 331 along a path P1 and discharges the ink rapidly into the negative pressure maintaining ink reservoir 320.
(5) Next, the valves 372 and 374 are closed, while the valves 371 and 375 are opened. By this operation, external air having debris removed by the filter 346 forces ink in the tube 333, ink head reference bag 360, tube 339, valve 375, and tube 341 along a path P2 and quickly into the negative pressure maintaining ink reservoir 320. Although ink accumulated in the negative pressure maintaining ink reservoir 320 can be discarded, in the present embodiment the ink is introduced into the deaerating device 390 via the tube 342 and filter 348 and returned to the main ink tank 400. (The above operations (3), (4), and (5) make up S3).

Since the ink is discharged in the direction from the ink supplying side of the recording head 100 toward the nozzle hole side in the process described above, debris is not drawn in through the nozzle holes of the recording head 100, thereby preventing the nozzle holes from becoming clogged.

In the embodiment of the present invention, the ink discharging path is divided into two systems, that are the paths P1 and P2. The ink in each system of the ink discharging paths P1 and P2 is discharged independently and asynchronously. Specifically, the ink discharging path is divided into the path P1 that only includes the area around the recording head 100, and the path P2 that ranges from the main ink tank 400 to the recording head 100, but does not include the area around the recording head 100. Since ink is discharged independently along the paths P1 and P2, the inkjet recording device of the present invention can discharge ink quickly with extremely high efficiency. Since the path P1 is formed only around the recording head 100, this configuration is very effective in a recording head having high flow resistance, such as a line scanning type recording head having numerous nozzles.

Further, by providing the leak valve 373 in the middle of the ink channel to allow outside air to leak in, the air flowing in via the leak valve 373 during the ink discharge process quickly forces out ink in the channels. Accordingly, this construction eliminates such problems as ink discharge taking a lengthy time or ink becoming stagnant in the ink channel without being completely discharged.

Next, an evacuating process, which is the second process of the ink refilling operation, will be described.

(1) Valves 373, 374, and 376 are closed, while valves 371, 372, and 375 are opened.
(2) The suction pressure of the vacuum pump 350 is maximized to decrease the pressure in the negative pressure maintaining ink reservoir 320 and evacuate the hermetically sealed system connected to the negative pressure maintaining ink reservoir 320, including the tubes 341, 340, and 339; the ink head reference bag 360; the tubes 333, 334, and 335; the interior of the filter 345; the interior of the nozzles in the recording head 100; the nozzle cap 310; the tube 331 (S4). Since there is only a small amount of ink remaining in the recording head 100 and the ink supplying channel by the ink discharging process described above, this residual ink can be quickly deaerated. Accordingly, a vacuum degree of approximately −100 kPa is achieved in a short amount of time. If the degree of vacuum does not rise sufficiently (S5: NO), it is conceivable that the airtightness in the parts and tubes is poor. Accordingly, it is possible at this stage to perform a check for defective parts and assembled areas having poor airtightness (S6).

Next, an ink filling process, which is the third process in the ink refilling operation, is performed.

(1) Valves 376, 375, 374, 373, and 377 are closed, while valves 372 and 371 are opened.
(2) The valve 374 is also opened, allowing deaerated ink in the main ink tank 400 under atmospheric pressure to travel along the ink filling path P3, sequentially filling the tube 338, valve 374, tube 339, ink head reference bag 360, tubes 333 and 334, filter 345, tube 335, recording head 100, nozzle cap 310, and tube 331, and finally accumulating in the negative pressure maintaining ink reservoir 320 (S7).

Since the capacity of the negative pressure maintaining ink reservoir 320 is set to a sufficiently larger volume than the capacity of the ink filling path P3, there is little drop in a degree of vacuum during the ink filling process, enabling a high degree of vacuum to be maintained. Therefore, it is possible to fill the recording head 100 and the ink supplying channel with ink rapidly and without generating residual air bubbles. Further, since sufficiently deaerated ink in the main ink tank 400 is supplied along the ink filling path P3, there are no air bubbles along the path and if air bubbles are generated for any reason, they are dissolved in the ink and eliminated. Since ink is filled in the direction from the ink supplying side of the recording head 100 toward the nozzle hole side, debris is not drawn in through the nozzle holes of the recording head 100, thereby preventing the clogging of these nozzle holes.

In the ink filling process described above, after ink accumulates in the negative pressure maintaining ink reservoir 320, the vacuum pump 350 stops operating and allows air to leak in to reduce the internal negative pressure. If the vacuum pump 350 is not provided with a leaking function, it is possible to open the leak valve 377 to introduce air. By leaking air in this way, the negative pressure in the negative pressure maintaining ink reservoir 320, recording head 100, and ink channel along the ink filling path P3 gradually decreases and approaches atmospheric pressure.

Here, the hermetically sealed state of the nozzle cap 310 and the nozzle holes in the recording head 100 is maintained until the negative pressure in the ink channel becomes smaller than a pressure P at which menisci formed in the nozzle holes of the recording head 100 break (S8: NO; S9). When the negative pressure in the ink channel has become smaller than the pressure P (S8: YES), then the nozzle cap 310 is pulled free from the recording head 100 in S10 in the direction of the arrow B. Since the negative pressure in the ink channel is smaller than the pressure P, it is possible to complete the ink filling process satisfactorily without allowing air bubbles in the nozzle holes to become mixed in with the ink and without generating air bubbles by the shock caused by a sudden change in pressure when the nozzle cap 310 is removed. After the ink filling process is completed, the valve 376 is opened, enabling ink accumulated in the negative pressure maintaining ink reservoir 320 to be introduced into the deaerating device 390 via the tube 342 and filter 348, and subsequently returned to the main ink tank 400.

With the above steps, the ink filling process if completed. Subsequently, residual ink around the nozzle holes of the recording head 100 is removed by a normal purge process or wiping operation. If a device for detecting the ink droplet ejection state (not shown) or the like confirms that all nozzles can eject ink properly (S11: YES), then the recording head 100 is returned to the recording operation position L1 (S12), and the recording operation resumes (S13).

If it is determined that the ink filling process has not completed properly, for example, when nozzles incapable or ejecting ink properly cannot be improved or in fact worsen after the normal purge process or wiping operation (S11: NO), then the process returns to S2 and the first, second, and third processes are repeated.

Figure 3:
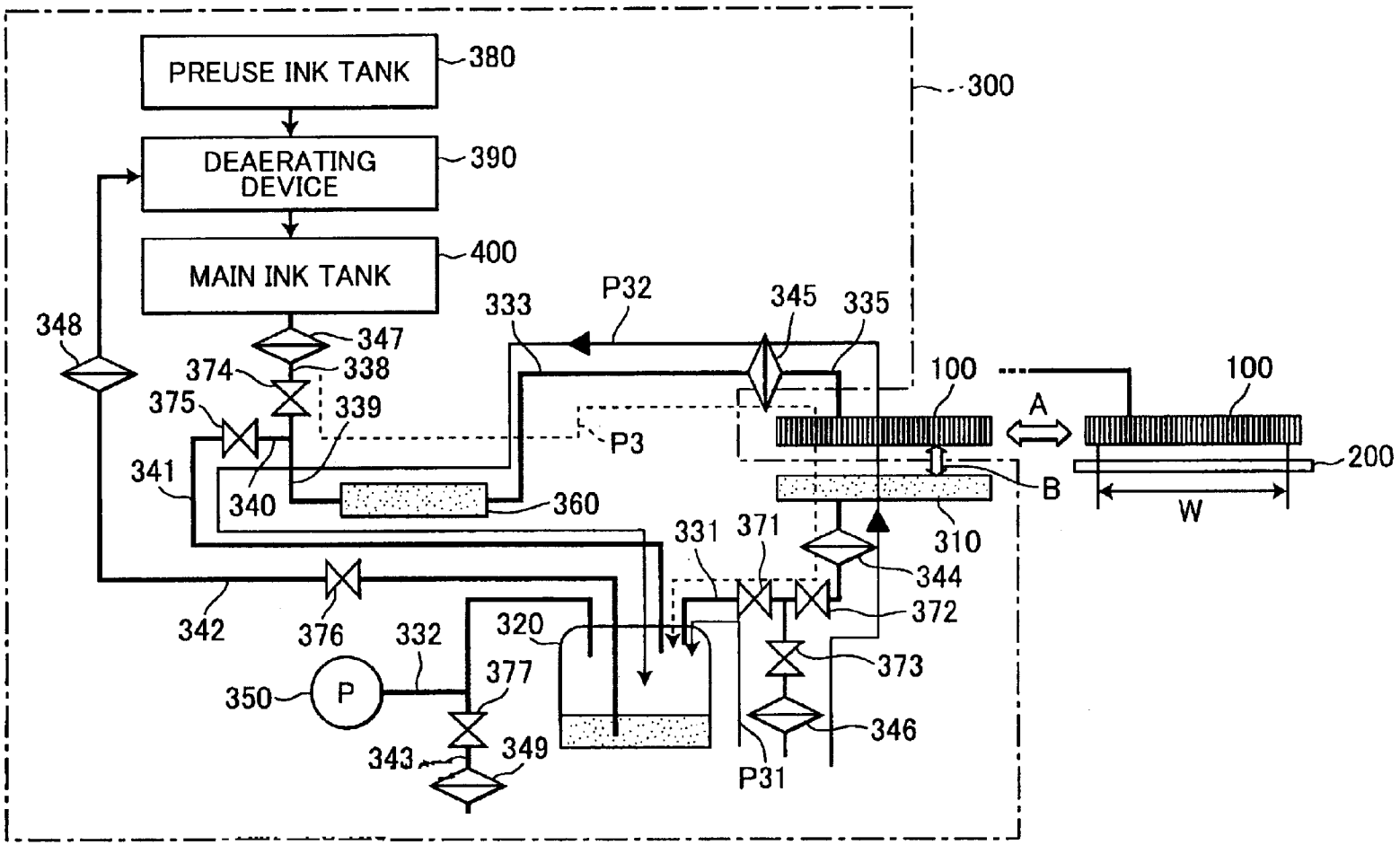
FIG. 3 is an explanatory diagram showing the construction of an ink supplying device for an inkjet recording device according to a second embodiment of the present invention.

FIG. 3 is an explanatory diagram showing the construction of an ink supplying device according to a second embodiment of the present invention, wherein like parts and components are designated by the same reference numerals to avoid duplicating description. The ink supplying device according to the second embodiment differs from the first embodiment in the point that the valves 371, 372, and 373, and the filter 346 are moved to the middle of the tube 331. In the first embodiment, the valves 371, 372, and 373, and the filter 346 were located in the middle of the tube 333 for allowing the leakage of external air to discharge ink from the ink channel. Also, a filter 344 has been added in the tube 344 in the present embodiment. The ink discharging process in the present embodiment is performed according to the following steps.

(1) The nozzle openings in the recording head 100 are hermetically sealed by the nozzle cap 310.
(2) The valves 371, 374, and 376 are closed, while the valves 372, 373, and 375 are opened.
(3) The leak valve 377 is closed and the vacuum pump 350 is operated to generate a negative pressure in the negative pressure maintaining ink reservoir 320. Since the tube 331 is opened to the outside air, allowing air to leak in via the filter 346, this air having been cleared of debris by the filter 346 forces ink in the tube 331, filter 344, nozzle cap 310, recording head 100, tube 335, filter 345, tube 333, ink head reference bag 360, tube 339, valve 375, and tube 341 along a path P32 and quickly discharge the ink into the negative pressure maintaining ink reservoir 320.

(4) Next, the valves 372 and 375 are closed and the valve 371 is opened, allowing external air to force ink accumulated in the tube 331 along a path P31 and to discharge the ink quickly into the negative pressure maintaining ink reservoir 320. At this time, debris is removed from the external air by the filter 346. In this way, by providing a function to allow external air to leak into the Tubes 331, 335, 333, 339, 340, or 341, it is possible to discharge ink from the ink supplying channel and the recording head 100 quickly.

Figure 4:
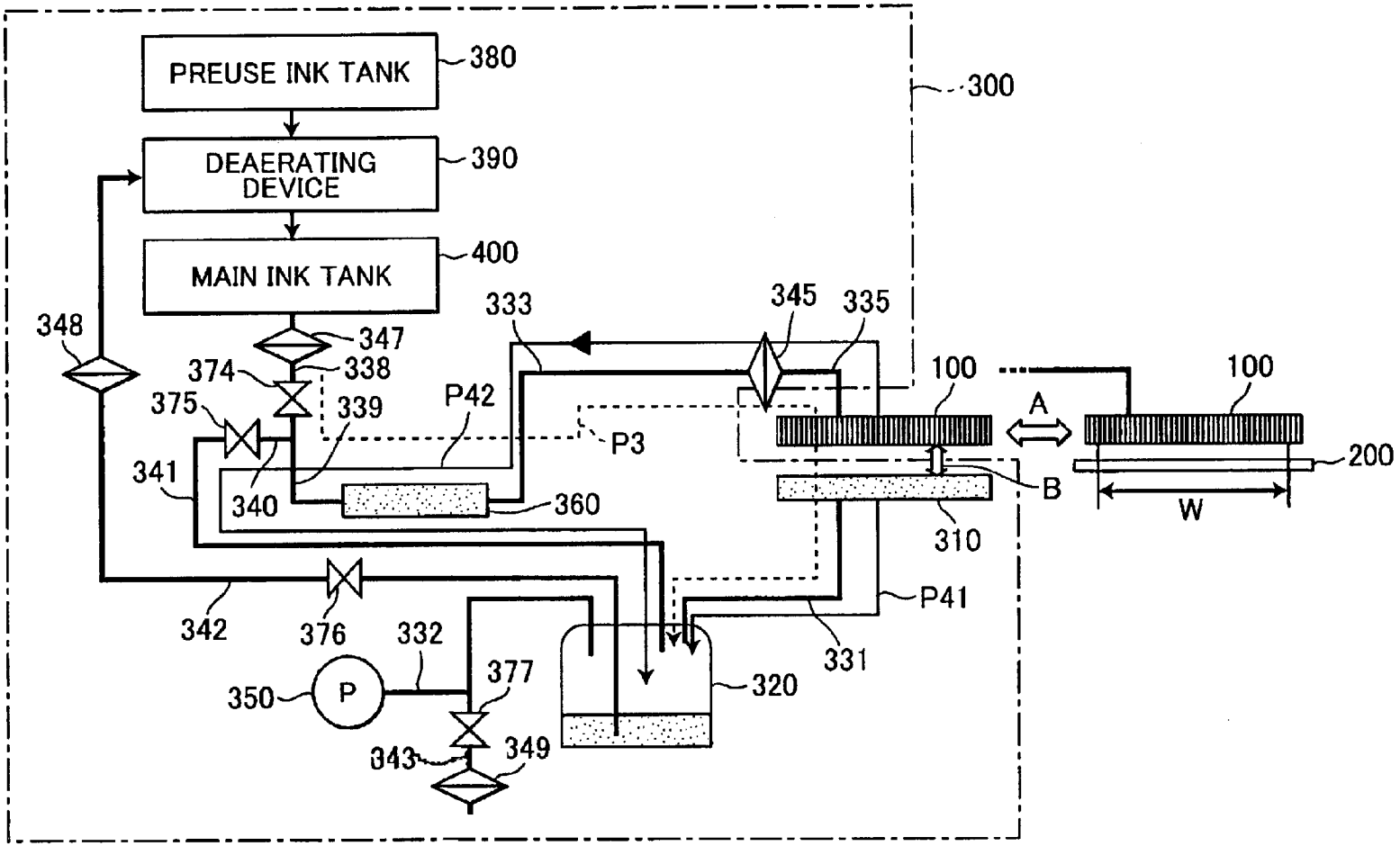
FIG. 4 is an explanatory diagram showing the construction of an ink supplying device for an inkjet recording device according to a third embodiment of the present invention.

FIG. 4 is an explanatory diagram showing the construction of an ink supplying device according to a third embodiment of the present invention, wherein like parts and components are designated by the same reference numerals to avoid duplicating description. The ink supplying device according to the third embodiment differs from the first embodiment in that the valves 371, 372, and 373, and the filter 346 located in the middle of the tube 333 for allowing the leakage of external air are omitted to simplify the construction. The ink discharging process in the present embodiment is performed according to the following steps.

(1) The nozzle cap 310 is maintained over the recording head 100 without hermetically sealing the nozzle holes in the recording head 100.
(2) The valves 374, 375, 376, and 377 are closed.
(3) The vacuum pump 350 is operated to generate a negative pressure in the negative pressure maintaining ink reservoir 320, thereby allowing outside air to enter through the nozzle cap 310 and forcing ink into the nozzle cap 310 and tube 331 along a path P41 and discharging the ink into the negative pressure maintaining ink reservoir 320.
(4) The valve 375 is opened, allowing outside air to enter through the nozzle holes of the recording head 100. The air entering the nozzle holes forces ink in the recording head 100, tube 335, filter 345, tube 333, ink head reference bag 360, tube 339, tube 340, valve 375, and tube 341 along a path P42 and discharging the ink quickly into the negative pressure maintaining ink reservoir 320.

In this way, the ink discharging process of the present embodiment can be implemented with a simple construction. However, while the first and second embodiments do not have the problem of the nozzle holes in the recording head 100 clogging from foreign matter or debris by providing the filter 346 for filtering dust in the air before the air passes through the ink supplying channel and the recording head 100. In the present embodiment, external air is drawn through the nozzle holes, allowing dust to become deposited in the nozzle holes and bringing in a relatively large amount of dust into the recording head 100 and the ink supplying channel. However, this problem can be resolved by removing dust from the air by supplying the air free from dust to the nozzle holes of the recording head 100, or by applying another method, to prevent any dust from floating near the nozzle openings in the recording head 100.

Figure 5:
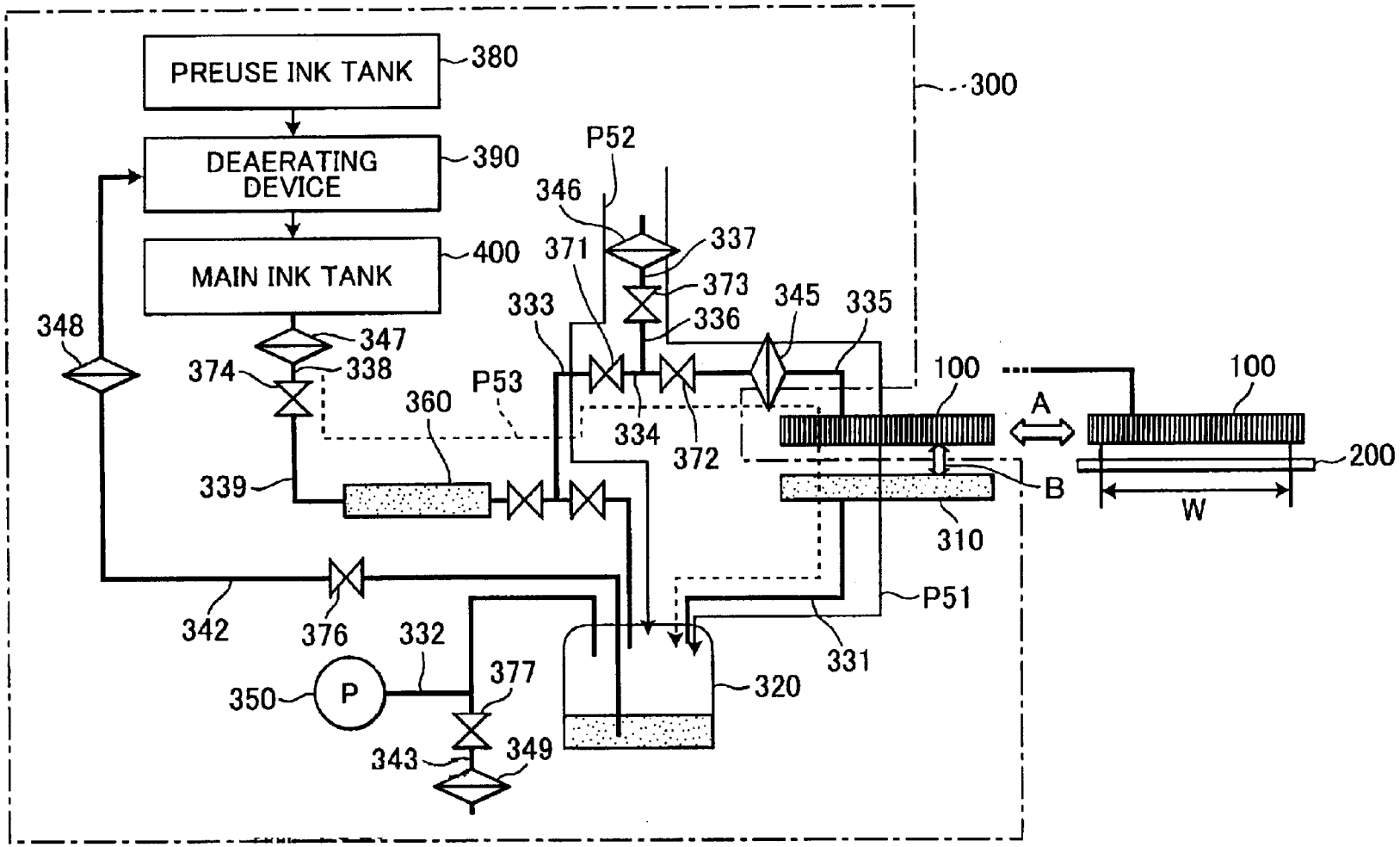
FIG. 5 is an explanatory diagram showing the construction of an ink supplying device for an inkjet recording device according to a fourth embodiment of the present invention.

FIG. 5 is an explanatory diagram showing the construction of an ink supplying device according to a fourth embodiment of the present invention, wherein like parts and components are designated by the same reference numerals to avoid duplicating description. The ink supplying device according to the fourth embodiment differs from the first embodiment in that the ink head reference bag 360 is not included on the ink discharge path in the ink channel and ink is discharged along ink paths P51 and P52. While the path P51 has the same construction as the path P1 in the first embodiment, the path P52 differs from the path P2 in the first embodiment in that the tube does not pass through the ink head reference bag 360. The ink discharging process is identical to that in the first embodiment described above. Since it is possible to shorten the ink discharge path and reduce the amount of ink discharged with this construction, it is possible to greatly reduce the time required to discharge the ink.

Figure 6:
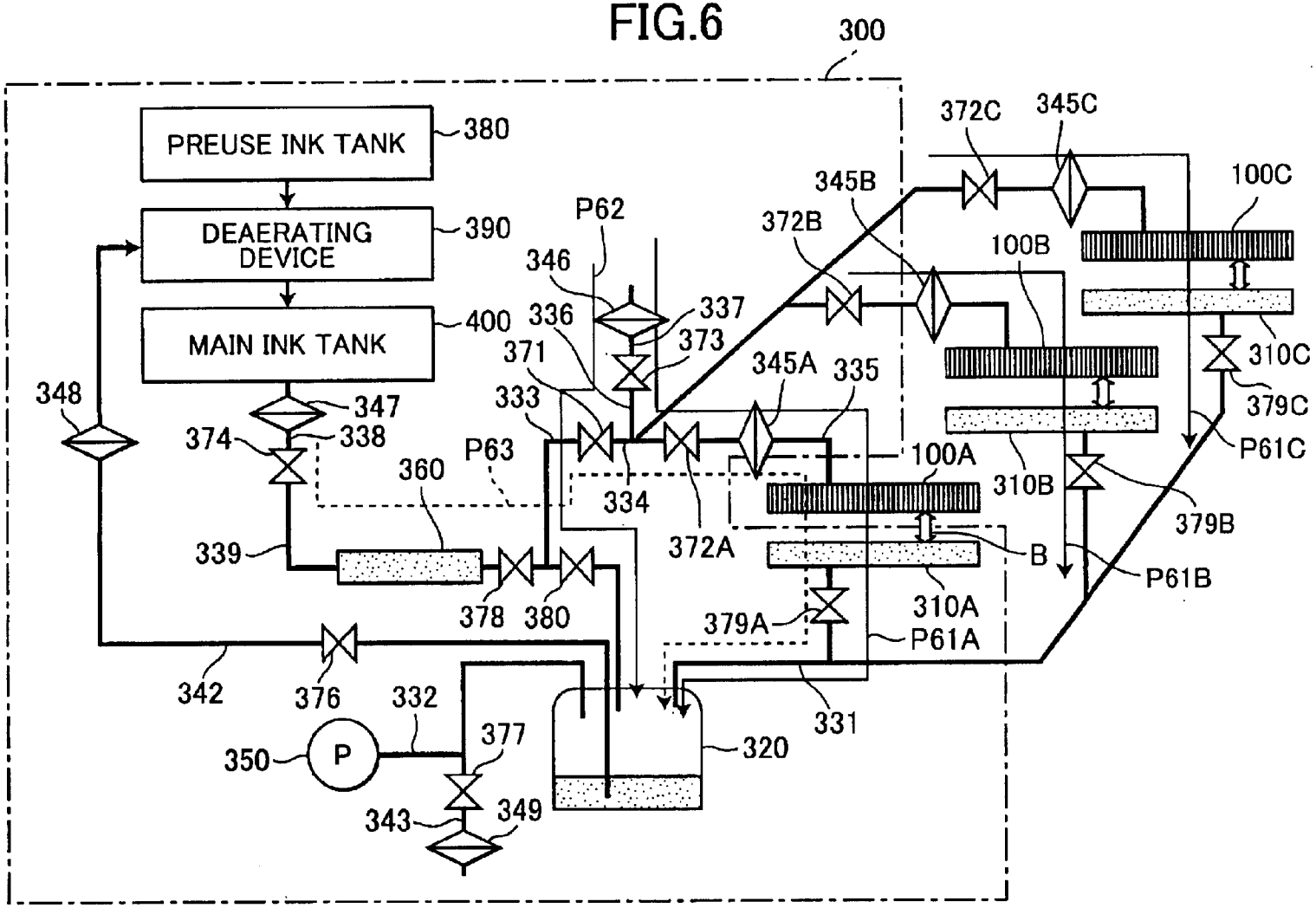
FIG. 6 is an explanatory diagram showing the construction of an ink supplying device for an inkjet recording device according to a fifth embodiment of the present invention.

FIG. 6 is an explanatory diagram showing the construction of an ink supplying device according to a fifth embodiment of the present invention, wherein like parts and components are designated by the same reference numerals to avoid duplicating description. The ink supplying device according to the fifth embodiment differs from the fourth embodiment in that a plurality of ink paths P61 are provided for each of a plurality of the recording heads 100. In the fifth embodiment, three ink paths P61 (P61A, P61B, P61C) are provided for three recording heads 100 (100A, 100B, 100C). However, the present invention is not particularly limited to any specific number of recording heads 100 and paths P61.

Along each of the paths P61 (P61A, P61B, P61C) are provided valves 379 (379A, 379B, 379C), the nozzle caps 310 (310A, 310B, 310C), the recording heads 100 (100A, 100B, 100C) the filters 345 (345A, 345B, 345C), and the valves 372 (372A, 372B, 372C).

When refilling the inkjet recording device with ink, the recording head 100 is hermetically sealed by the nozzle cap 310, and the valves 372 and 379 are opened only for one of the paths P61 through which ink will be refilled. For all other ink channels in which refilling is not performed, the recording heads 100 are not hermetically sealed by the nozzle caps 310, and the valves 372 and 379 are closed. When performing an ink discharging process or a refilling process along the path P61A, for example, the recording head 100A is hermetically sealed by the nozzle cap 310A, and the valves 372A and 379A are opened. For the paths P61B and P61C, which are not to be refilled, the recording heads 100B and 100C are not hermetically sealed by the nozzle caps 310B and 310C, respectively, and the valves 372B, 372C, 379B, and 379C are closed.

With this operation, it is possible to refill only the ink channel that requires refilling, thereby reducing the time required to discharge ink from the ink channels and to refill the channels with ink. Since a smaller volume of ink needs to be discharged, it is possible to reduce the amount of discarded ink, in the case ink is discarded, thereby reducing the amount of ink consumption.

Figure 7:
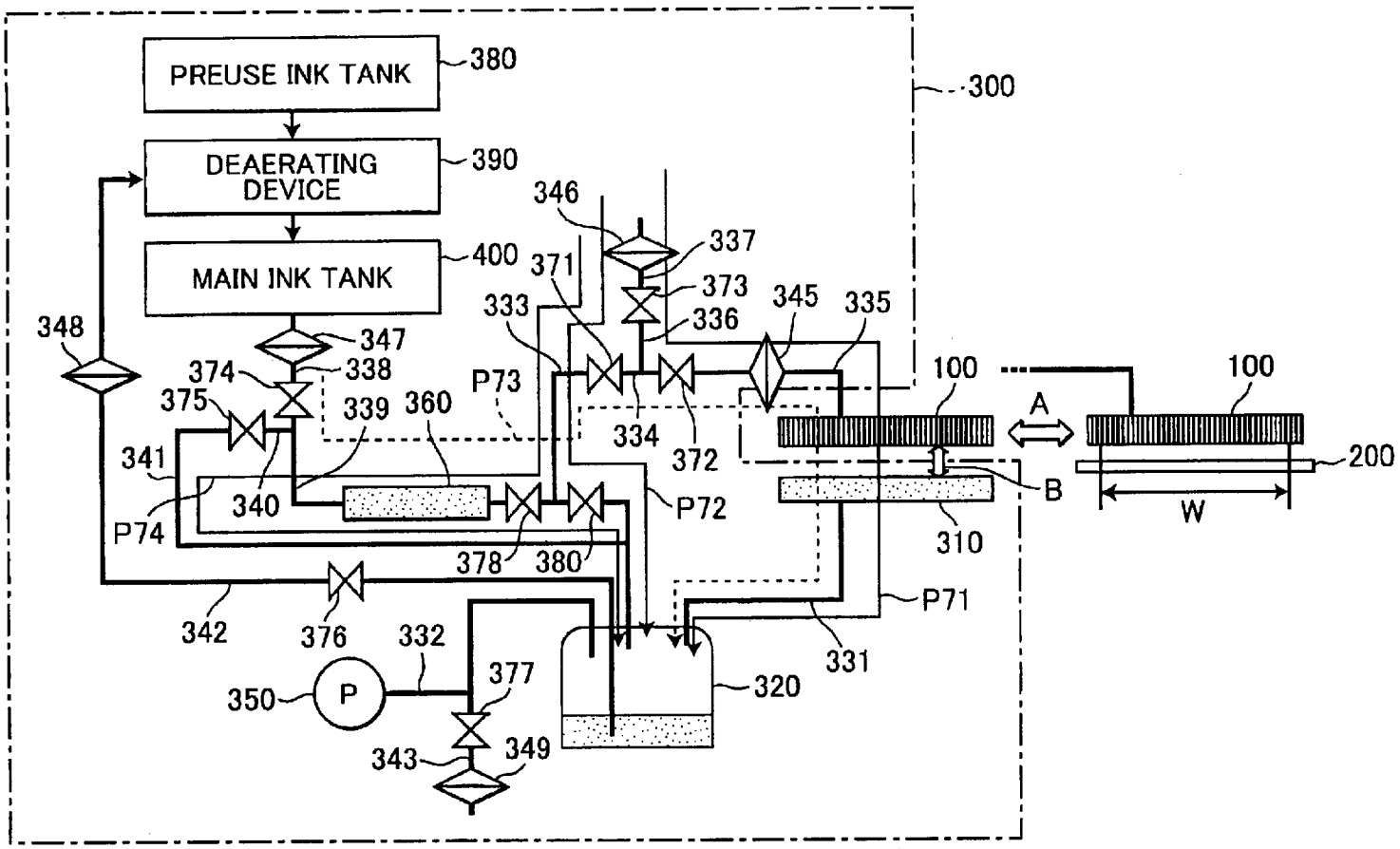
FIG. 7 is an explanatory diagram showing the construction of an ink supplying device for an inkjet recording device according to a sixth embodiment of the present invention.

FIG. 7 is an explanatory diagram showing the construction of an ink supplying device according to a sixth embodiment of the present invention, wherein like parts and components are designated by the same reference numerals to avoid duplicating description. The ink supplying device according to the sixth embodiment differs from the fourth embodiment in that the ink supplying device of the sixth embodiment further includes the tubes 340 and 341 and the valve 375, and is provided with a new ink path P74. With this configuration, it is possible to discharge ink efficiently from the ink head reference bag 360, tube 339, and the like making up an ink supplying path P73. First, ink is discharged from a path P71. Next, ink in a path P72 is discharged. Finally, ink in the path P74 is discharged.

In this way, the ink supplying path P73 is divided into a plurality or sections, and the paths P71, P72, and P74 are provided for independently discharging ink in the divided sections of the ink channel. This construction reduces the amount of ink discharged and enables air for discharging the ink to work effectively on the ink in the ink channels, thereby discharging the ink efficiently and in a short amount of time. Further, since ink in each ink path P71, P72, and P74 is discharged in sequence and not simultaneously, the effective amount of the airflow for discharging ink for each ink path is increased, thereby discharging the ink in even a shorter amount of time.

Figure 8:
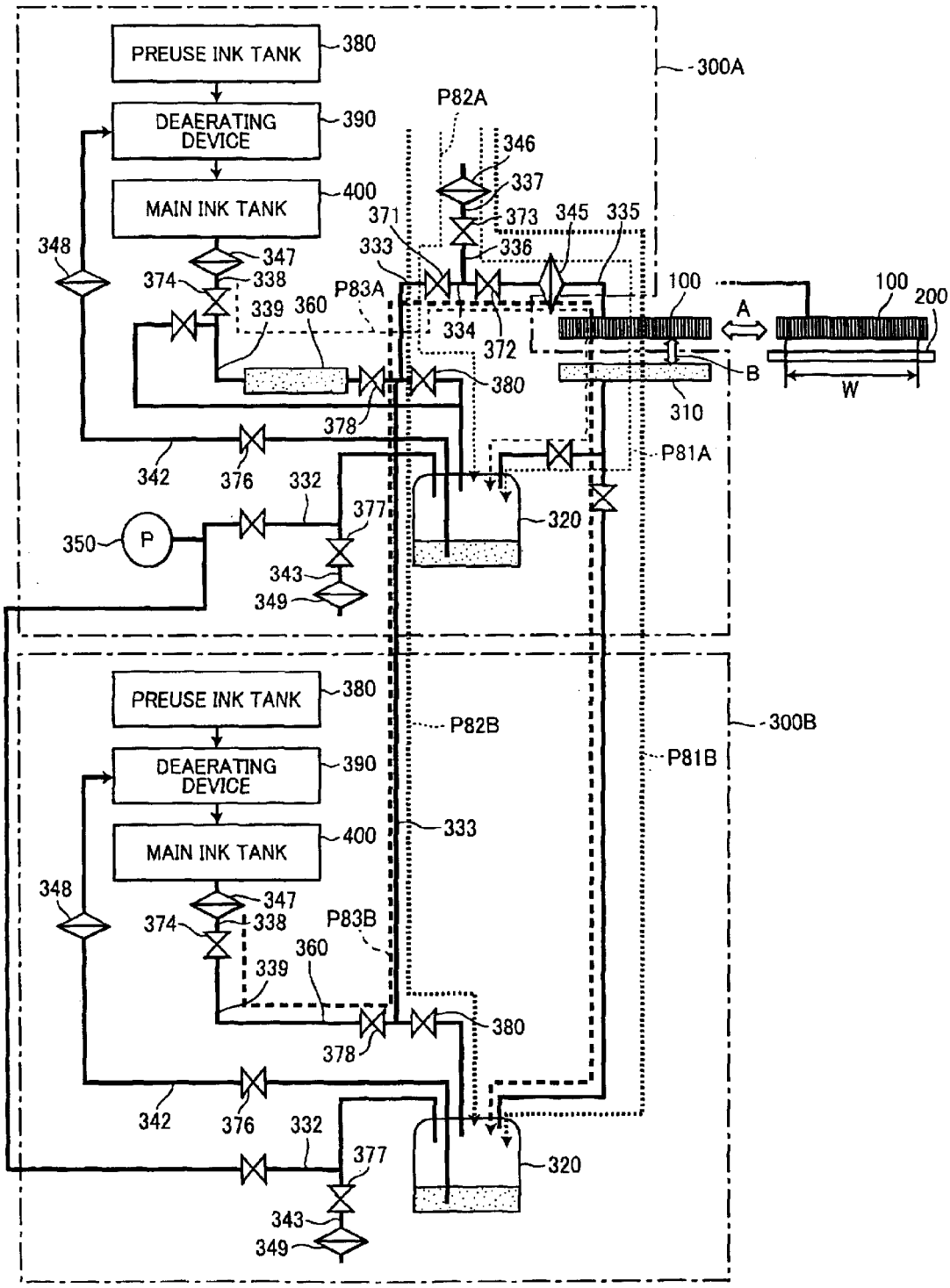
FIG. 8 is an explanatory diagram showing the construction of an ink supplying device for an inkjet recording device according to a seventh embodiment of the present invention.

FIG. 8 is an explanatory diagram showing the construction of an ink supplying device according to a seventh embodiment of the present invention, wherein like parts and components are designated by the same reference numerals to avoid duplicating description. The ink supplying device according to the seventh embodiment differs from the sixth embodiment in that the seventh embodiment includes two ink supplying devices 300A and 300B, and the recording head 100 can be refilled with two types of fluid. For example, the ink supplying device 300A is used to refill the recording head 100 and the ink channel with recording ink for performing recording operations, while the ink supplying device 300B is used to refill the recording head 100 and the ink channel with a maintenance ink for dissolving agglomerates in the recording ink. Hence, when the inkjet recording device is operating, the recording head 100 and the ink channel can be filled with deaerated recording ink free of residual air bubbles. When the inkjet recording device is not performing a recording operation, the recording head 100 and the ink channel can be filled completely with maintenance ink.

While devices that alternately supply recording ink and maintenance ink to the recording head in order to dissolve ink agglomerates and maintain the reliability of the device are known in the art, these devices have been insufficiently reliable in supplying maintenance ink to all internal areas of the recording head and the ink channel. It has also been difficult to replace the maintenance ink with recording ink free from residual air bubbles prior to resuming the recording operation and to replace the ink in a short amount of time. The ink supplying device according to the present embodiment is configured to quickly discharge ink from the recording head and the ink channel, evacuate the recording head and ink channel, and fill the evacuated recording head and ink channel with deaerated ink, for both recording ink and maintenance ink.

When filling the recording head and ink channel with maintenance ink, ink in the recording head and tubes is discharged into the negative pressure maintaining ink reservoir 320 for recording ink via paths P81A and P82A. Subsequently, the recording head 100 and the ink channel are evacuated. Next, deaerated maintenance ink is introduced along a path P83B. When switching back from maintenance ink to recording ink in order to resume recording operations, the maintenance ink is discharged into the negative pressure maintaining ink reservoir 320 for maintenance ink via paths P81B and P82B. Next, the recording head 100 and the ink channel are evacuated, and deaerated recording ink is introduced via a path P83A.

While the embodiment shown in FIG. 8 is described for switching between two types of ink in the recording head 100, the present invention is not limited to the number of ink types. For example, it is possible to construct an inkjet recording device using four types of recording ink and one type of cleaning ink. For example, the inkjet recording device includes four recording ink supplying devices 300A and one cleaning ink supplying device 300B. Each ink supplying device is configured to discharge ink from the recording head 100 and the ink channel rapidly, to evacuate the recording head and the ink channel, and to fill the recording head and the ink channel with deaerated ink. With this construction, it in possible to perform recording operations while switching among the plurality of types of ink in a short amount of time.

In an inkjet recording device that alternately supplies oil-based ink and water-based ink to the recording head for printing operations, it is necessary to also provide two or more types of cleaning inks. This can be accomplished by providing cleaning ink supplying devices 300B to correspond to each type of cleaning ink.

Figure 9:
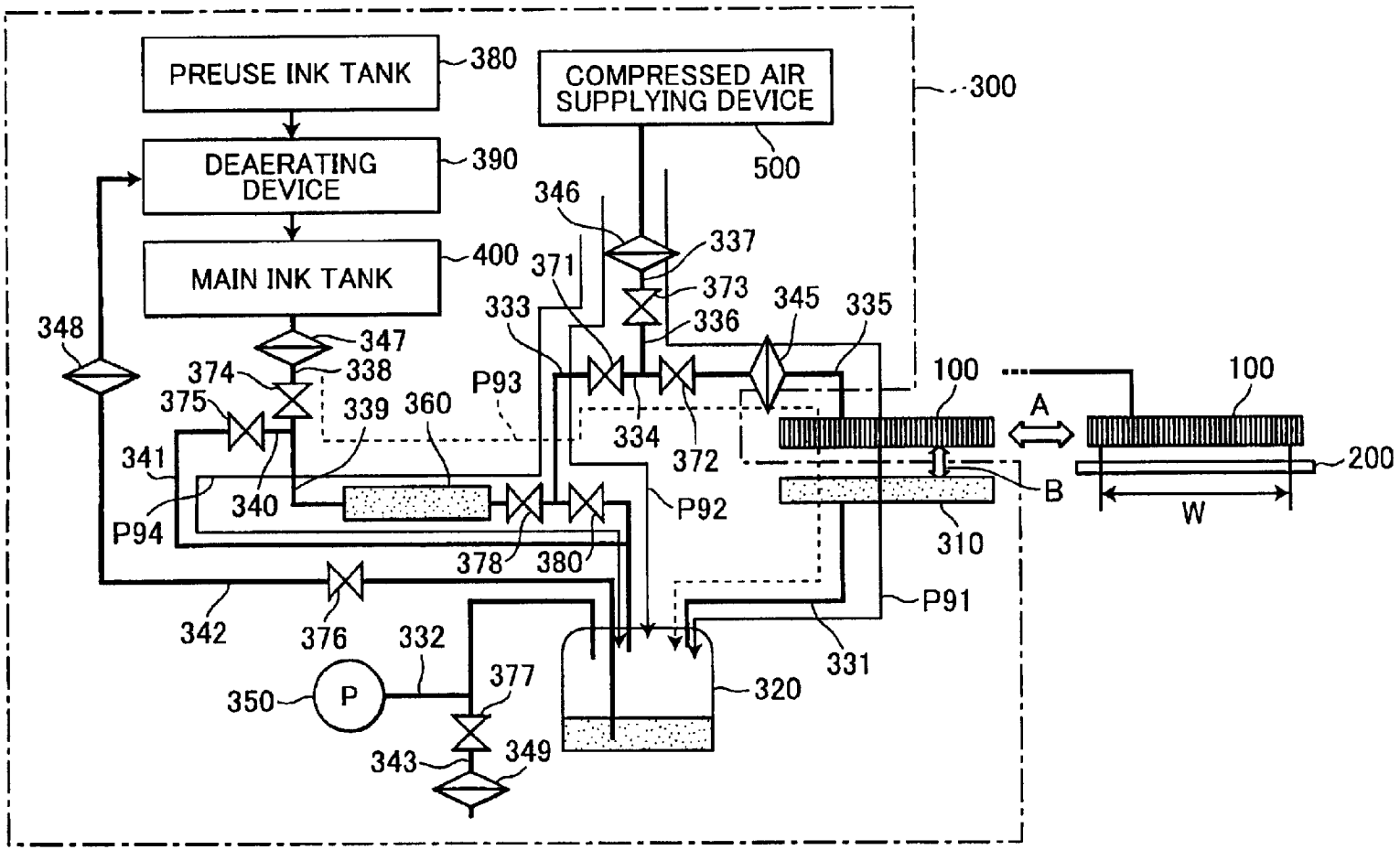
FIG. 9 is an explanatory diagram showing the construction of an ink supplying device for an inkjet recording device according to an eighth embodiment of the present invention.

FIG. 9 is an explanatory diagram showing the construction of an ink supplying device according to an eighth embodiment of the present invention, wherein like parts and components are designated by the same reference numerals to avoid duplicating description. The ink supplying device according to the eighth embodiment differs from the sixth embodiment in that a compressed air supplying device 500 for supplying compressed air to the ink channel and the recording head 100 is provided at an end of the tube 337. With this construction, compressed air can be supplied via ink paths P91, P92, and P94. Accordingly, a high-pressure airflow in the ink channel can be generated by introducing air at a higher rate of speed than in the method of the sixth embodiment, wherein the tube 337 is opened to allow outside air to leak into the ink channel. Therefore, the ink discharging process can be executed in an even shorter amount of time.

As described above, the inkjet recording device and the ink supplying device according to the present invention can be sufficiently evacuated even in a line scanning type inkjet printer having numerous nozzles and complex, long, and wide ink supplying channels. The recording head and ink channel in the inkjet recording device and ink supplying device are evacuated after discharging ink existing in the recording head and ink channel. Further, the recording head and ink channel can be filled with deaerated ink quickly, eliminating residual air bubbles in the ink.

Since the present invention includes a nozzle cap 310 for protecting the nozzle holes in the recording head 100 and an negative pressure maintaining ink reservoir 320 connected to the nozzle cap 310, it is possible to further reduce the potential for introducing air bubbles when filling the recording head 100 and ink channel with ink.

The nozzle cap 310 maintains a hermetic seal over the nozzle holes in the recording head 100 during the ink filling process until the negative pressure in the ink channel becomes smaller than the pressure at which menisci formed in the nozzle holes break. Accordingly, this construction eliminates the problem of air bubbles around the nozzle holes becoming mixed in with the ink or other air bubbles being generated in the ink channel.

When performing ink discharging and ink filling processes, ink is discharged or filled in the direction from the ink supplying side of the recording head 100 toward the nozzle hole side. Accordingly, the present invention can prevent the clogging of the nozzle holes by foreign matters or debris that is sucked therethrough.

As described above, in the inkjet recording device according to the present invention, the recording head and ink supplying channel can be reliably filled with ink that is free from residual air bubbles, even in a line scanning type inkjet printer having numerous nozzles and complex, long, and wide ink supplying channels. Further, ink free from residual air bubbles can be introduced in a short amount of time. Accordingly, the inkjet recording device can quickly resume highly reliable recording operations. Further, an appropriate ink supplying device can be provided in the line scanning type inkjet printer that resolves the problem of nozzle holes clogging during the ink filling process.

While the invention has been described in detail with reference to specific embodiments thereof, it would be apparent to those skilled in the art that many modifications and variations may be made therein without departing from the spirit of the invention.

For example, in the above-described embodiments, the present invention was applied to a line scanning type inkjet printer employing an on-demand inkjet system. However, the present invention can similarly be applied to an inkjet printer employing a continuous inkjet system. In this example as well, ink supplying channels and recording heads can be filled with ink that is free from air bubbles. The present invention can improve the reliability of recording operations by preventing disorders in ink particle creation and disorders in electric charges that are caused by air bubbles.

What is claimed is:

1. An inkjet recording device comprising:

an ink reservoir that stores ink;

a recording head having a plurality of nozzle holes for forming recording dots on a recording medium by ejecting ink particles from the plurality of nozzle holes onto the recording medium positioned opposite the plurality of nozzle holes;

an ink channel for supplying ink from the ink reservoir to the recording head;

ink discharging means for discharging ink from the recording head and the ink channel;

evacuating means for creating a vacuum state in the recording head and the ink channel; and ink filling means for filling the evacuated recording head and ink channel with deaerated ink, wherein the ink discharging means divides the recording head and the ink channel into a plurality of sections and independently discharges ink from each section of the recording head and the ink channel.

2. The inkjet recording device as claimed in claim 1, wherein the ink discharging means comprises leaking means provided on the ink channel, the leaking means opening the ink channel to external air.

3. The inkjet recording device as claimed in claim 2, wherein the leaking means comprises a filter, the leaking means opened to outside air via the filter.

4. The inkjet recording device as claimed in claim 1, wherein:

the evacuating means independently creates a vacuum state in each section of the recording head and the ink channel; and the ink filling means independently fills each evacuated section of the recording head and the ink channel with deaerated ink.

5. The inkjet recording device as claimed in claim 1, wherein the ink discharging means independently and asynchronously discharges ink from each section of the recording head and the ink channel.

6. The inkjet recording device as claimed in claim 1, wherein the recording head comprises an ink supplying side and a nozzle hole side, the ink discharging means discharging ink in a direction from the ink supplying side toward the nozzle hole side.

7. The inkjet recording device an claimed in claim 1, wherein the recording head comprises an ink supplying side and a nozzle hole side, the ink filling means filling the recording head and the ink channel with ink in a direction from the ink supplying side toward the nozzle hole side.

8. The inkjet recording device as claimed in claim 1, further comprising:

a nozzle cap for covering the nozzle holes in a hermetically sealed state; and a negative pressure maintaining ink container in fluid communication with the nozzle cap, the negative pressure maintaining ink container for maintaining the vacuum state in the recording head and the ink channel created by the evacuating means.

9. The inkjet recording device as claimed in claim 8, wherein the ink filling means maintains the hermetically sealed state with the nozzle cap until a negative pressure in the ink channel becomes smaller than a pressure at which menisci formed in the nozzle holes break.

10. The inkjet recording device as claimed in claim 1, further comprising at least another recording head and at least another ink channel, each of the ink channels supplying ink to a corresponding one of the recording heads.

11. The inkjet recording device as claimed in claim 1, wherein the ink discharging means comprises compressed air supplying means connected to the ink channel, the compressed air supplying means supplying compressed air to the ink channel and the recording head.

12. An inkjet recording device comprising:

an ink reservoir that stores ink;

a recording head having a plurality of nozzle holes for forming recording dots on a recording medium by ejecting ink particles from the plurality of nozzle holes onto the recording medium positioned opposite the plurality of nozzle holes;

an ink channel for supplying ink from the ink reservoir to the recording head;

ink discharging means for discharging ink from the recording head and the ink channel;

evacuating means for creating a vacuum state in the recording head and the ink channel; and ink filling means for filling the evacuated recording head and ink channel with deaerated ink, wherein the ink discharging means comprises external air introducing means introducing external air into the ink channel.

13. The inkjet recording device as claimed in claim 12, wherein the external air introducing means is leaking means provided on the ink channel, the leaking means opening the ink channel to external air.

14. The inkjet recording device as claimed in claim 12, wherein the external air introducing means is compressed air supplying means connected to the ink channel, the compressed air supplying means supplying compressed air to the ink channel and the recording head.

15. The inkjet recording device as claimed in claim 12, wherein the external air introducing means comprises a filter, the external air introducing means opened to outside air via the filter.

16. The inkjet recording device as claimed in claim 12, further comprising:

a nozzle cap for covering the nozzle holes in a hermetically sealed state; and a negative pressure maintaining ink container in fluid communication with the nozzle cap, the negative pressure maintaining ink container for maintaining the vacuum state in the recording head and the ink channel created by the evacuating means.

17. The inkjet recording device as claimed in claim 16, wherein the ink filling means maintains the hermetically sealed state with the nozzle cap until a negative pressure in the ink channel becomes smaller than a pressure at which menisci formed in the nozzle holes break.

18. An ink supplying device for an inkjet recording device having a recording head, the ink supplying device selectively supplying one of a plurality of types of ink to the recording head, the ink supplying device comprising for each of the plurality of types of ink:

an ink channel for supplying ink to the recording head;

ink discharging means for discharging ink from the recording head and the ink channel;

evacuating means for creating a vacuum state in the recording head and the ink channel; and ink filling means for filling the evacuated recording head and ink channel with deaerated ink, wherein the ink discharging means comprises external air introducing means introducing external air into the ink channel.

19. The ink supplying device as claimed in claim 18, wherein the external air introducing means is leaking means provided on the ink channel, the leaking means opening the ink channel to external air.

20. The ink supplying device as claimed in claim 18, wherein the external air introducing means is compressed air supplying means connected to the ink channel, the compressed air supplying means supplying compressed air to the ink channel and the recording head.

* * * * *